US005839966A

United States Patent [19]

Eisenhauer et al.

[11] Patent Number: 5,839,966

[45] Date of Patent: Nov. 24, 1998

[54] SLATE LEVELING SYSTEM FOR A BILLIARD TABLE

[75] Inventors: Marvin Eisenhauer, Antioch, Ill.; William R. McCormick, Kenosha, Wis.

[73] Assignee: Brunswick Bowling & Billiards, Bristol, Wis.

[21] Appl. No.: 939,312

[22] Filed: Sep. 29, 1997

[51] Int. Cl.[6] ..... A63J 3/00

[52] U.S. Cl. ..... 473/29

[58] Field of Search ..... 473/29

[56] References Cited

U.S. PATENT DOCUMENTS

| | | | |
|---|---|---|---|
| 921,651 | 5/1909 | Bracher | 473/29 |
| 3,658,328 | 4/1972 | Kooker | 473/29 |
| 4,027,878 | 6/1977 | Dadbeh | 473/29 |
| 4,093,216 | 6/1978 | Dunn | 473/29 |
| 5,161,797 | 11/1992 | Frasea | 473/29 |

*Primary Examiner*—Theatrice Brown

*Attorney, Agent, or Firm*—Wood, Phillips, Vansanten, Clark & Mortimer

[57] ABSTRACT

Time consuming, unreliable leveling of the playing surface of a billiard table is eliminated in a billiard table including a base frame (10) adapted to be supported above the underlying terrain by legs. The base frame has an upper top plate (12) of generally rectangular configuration and a slate bed made up of at least two slate sheets (24) with planar upper surfaces (26) disposed in a generally side by side abutting relation overlying the top plate (12). A plurality of nuts (52) are secured to the top plate (12) at predetermined locations thereon and a plurality of leveling screws (62) are provided, one for each nut (52). Each leveling screw includes a threaded shank (62) received in the associated nut (52) in a radially outwardly directed flange (64) at one end of the shank at the interface of the top plate (12) and the slate sheets (24) and engaging one of the slate sheets (24). Through rotation of the leveling screws (62), the corresponding slate sheet (24) may be selectively raised, lowered or tipped to cause the planar surfaces (26) to be co-planar in a perfectly horizontal plane.

12 Claims, 2 Drawing Sheets

SLATE LEVELING SYSTEM FOR A BILLIARD TABLE

FIELD OF THE INVENTION

This invention relates to billiard tables, and more particularly, to a system for leveling the slate bed of a billiard table.

BACKGROUND OF THE INVENTION

Quality billiard tables, whether pocketless or provided with pockets, conventionally employ slate beds. The bed is typically made up of two or three sheets of slate, each having a planar upper surface which are abutted together in side by side relation. Wooden shims are driven between the underside of the slate sheets and the upper surface of the base frame of the table so as to bring the planar upper surfaces of all sheets into a co-planar relationship and to assure that the resulting plane is perfectly horizontal. Grout is then used to fill the seam between adjoining pieces of slate and the result is intended to be a perfectly horizontal playing surface with all parts of the playing surface in a single plane.

In the usual case, wooden wedges of various thicknesses and lengths are supplied with each table and are employed as shims by the installer for achieving leveling. However, other similar materials have been used.

One problem with the procedure is the fact that the same is time consuming and is almost entirely a trial and error method. Furthermore, over a period of time, the upper playing surface of the slate may retreat from a horizontal plane for any of a variety of reasons. For one, the shims may loosen or even fall out if not glued in place or otherwise secured in the place during the initial installation. Furthermore, if the shims are made up of wood which is not thoroughly dried, the shims may shrink as they dry. Furthermore, humidity changes within the building housing the table may cause the dimensions of the shims to vary somewhat, changing the effectiveness of the shims.

The present invention is directed to overcoming one or more of the above problems.

SUMMARY OF THE INVENTION

It is the principal object of the invention to provide a new and improved billiard table. More specifically, it is an object of the invention to provide a new and improved slate leveling system for a billiard table.

An exemplary embodiment of the invention achieves the foregoing object in a structure that includes a base frame adapted to be supported above the underlying terrain by legs. The base frame has an upper top plate of generally rectangular configuration. A slate bed made up of at least one rectangular slate sheet having a planar upper surface overlies the top plate and a plurality of nuts are secured to the top plate in spaced relation to one another and underlie the periphery of the slate sheet. A plurality of leveling screws, one for each, is provided. Each leveling screw includes a threaded shank threadably received in the associated nut and a radially outward directed flange at one end of the shank at the interface of the top plate in the slate sheet and engaging the slate sheet. As a consequence, part or parts of the periphery of the slate sheet may be raised, lowered or tipped to locate the planar surface in a perfectly horizontal plane by rotation of selective ones of the leveling screws.

In a preferred embodiment, the slate bed is made up of at least two pieces of slate sheets with planar upper surfaces and in generally side by side abutting relation.

In a preferred embodiment, the flanges on the leveling screws have polygonal peripheries.

In a preferred embodiment, the end of each shank opposite the end having the flange includes a tool receiving formation such as a slot.

Preferably, the top plate has a nut receiving and retaining bore at each of the predetermined locations. Each nut is secured in its associated bore and an enlarged counterbore is located in the top plate for each receiving and retaining bore. The counterbore has a diameter greater than the maximum diametrical dimension of the flange and a depth sufficient to receive the flange.

In one embodiment of the invention, the top plate comprises an open centered rectangular element having two opposed short sides and two opposed long sides connected at their ends by the short sides. At least one cross member extends between the long sides at a location that underlies the interface of the two slate sheets and there are at least two nuts in the cross member, one on each side of the projection of the slate sheet interface on the cross member.

Preferably, there are four of the nuts on the cross member arranged in two pairs. One of the pairs is closer to one of the long sides and the other of the pairs is closer to the other of the long sides. The nuts in each pair are on opposite sides of the projection.

In a preferred embodiment, the top plate also includes two long sides connected by two short sides and an interface between the slate sheets extends between the long sides. Each of the long sides has a pair of the nuts with the nuts of each pair being on opposite sides of a projection of the slate sheet interface on the top plate.

Other objects and advantages will become apparent from the following specification taken in connection with the accompanied drawings.

DESCRIPTION OF THE PREFERRED EMBODIMENT

The present invention is described herein with reference to "billiard tables" but it is to be understood that it is not limited to billiard tables in the narrowest sense, that is, pocketless tables used for playing the game of billiards as opposed to games of pool or snooker. Rather, the term "billiard table" is intended to be generic to all such tables provided with rails surrounding an upper, planar, horizontal playing surface across which two or more balls may roll.

Figure 1:
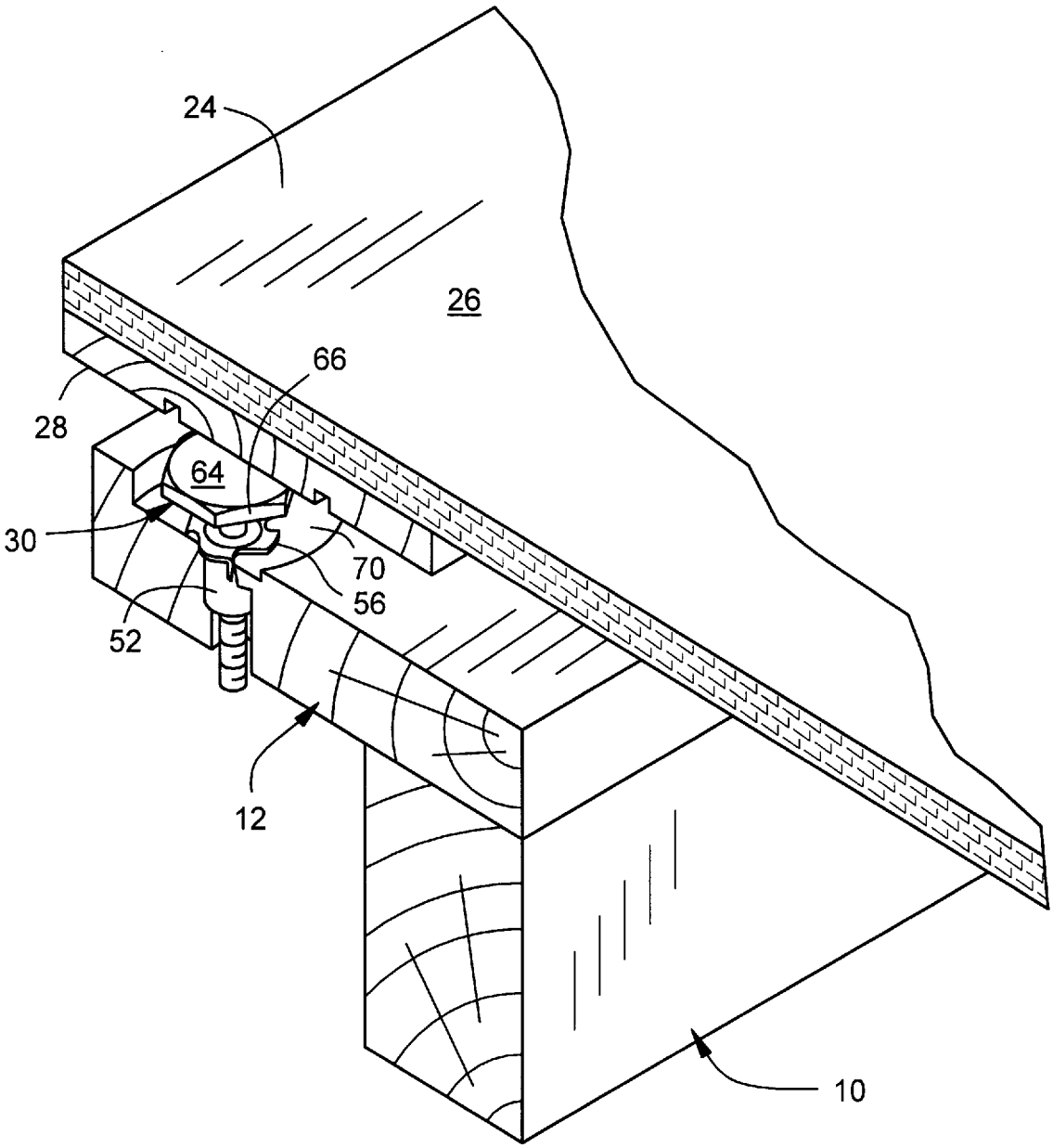
FIG. 1 is an enlarged, fragmentary perspective view of part of a billiard table embodying the invention.

Referring now to FIG. 1, as is well known, a billiard table will conventionally include a base frame, generally designated 10. The base frame in turn is supported by legs (not shown) for the purpose of elevating the playing surface above the surrounding terrain.

Figure 2:
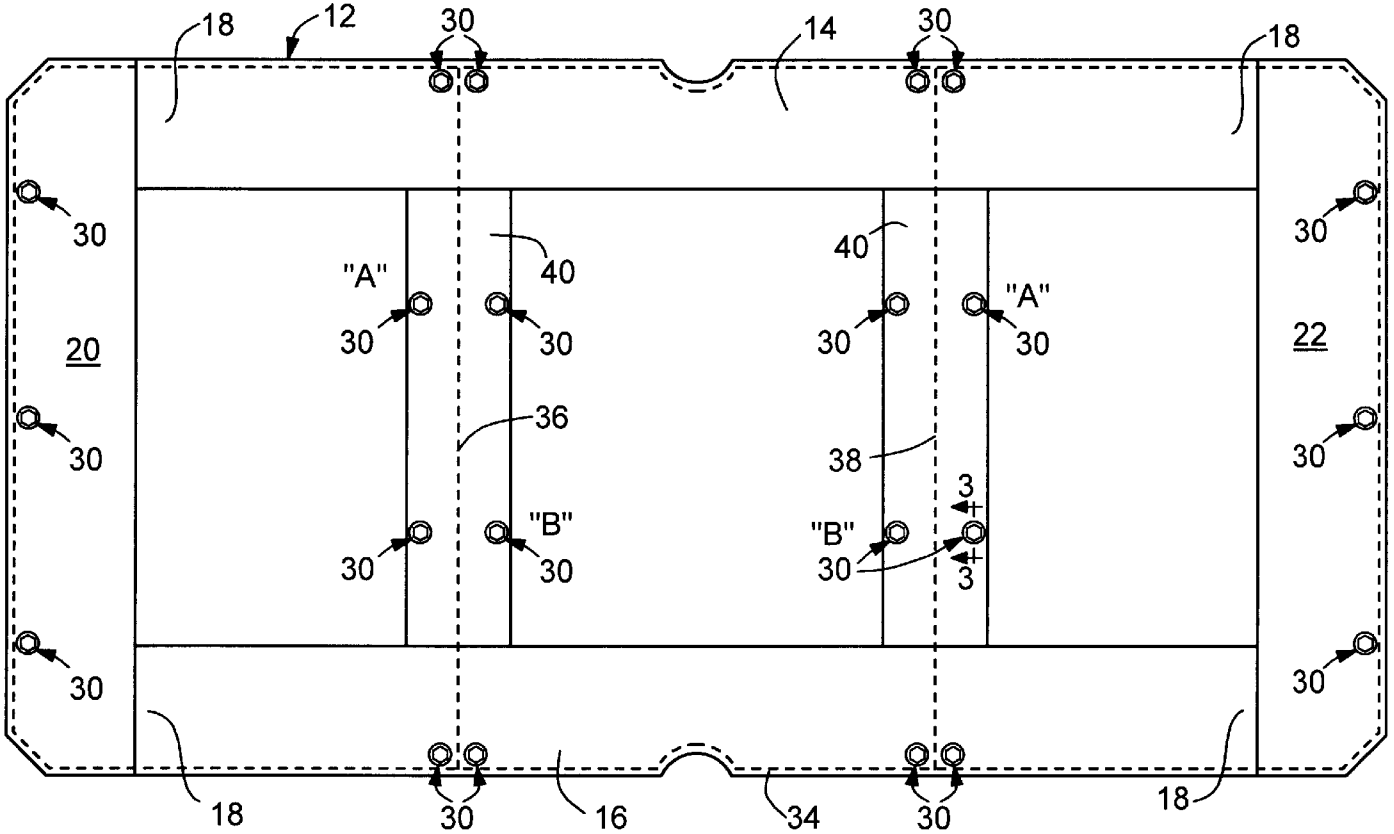
FIG. 2 is a plan view of part of the base frame of the billiard table.

The top of the base frame 10 is provided with a so called top plate, generally designated 12. As seen in FIG. 1, the top plate 12 will conventionally be formed of wood. It will be elongated in the direction of elongation of the corresponding side of the table with its narrowest dimension being vertical and its width being in a horizontal plane. As seen in FIG. 2, the top plate 12 may be open centered and made up of two opposed long sides 14 and 16 whose ends 18 are connected by opposed, short sides 20 and 22.

Returning to FIG. 1, at least one, and generally two or three, slate sheets 24 of a rectangular configuration overlie the top plate 12. The slate sheets 24 have a planar upper surface 26. In the usual case, the undersurface will be planar as well but need not be as precisely milled to a planar configuration.

Typically, but not always, a length of wood board 28 may be located about the periphery of the sheet 24 above the top plate 12.

According to the invention, a plurality of leveling screws, each generally designated 30, are provided at selected locations about the top plate 12 in lieu of shims. Each leveling assembly 30 may be extended away from or retracted into the top plate 12 while in engagement with one or more of the sheets 24 near the peripheries thereof to raise, lower or tip the same to enable the attainment of a perfectly horizontal orientation of the planar upper surface 26. In addition, when plural slate sheets 24 are used, the leveling assemblies 30 are employed to assure that the planar upper surfaces 26 of all of the sheets are in a common horizontal plane.

FIG. 2 illustrates the location of the leveling assemblies 30 for a table wherein three sheets of slate are used to form the bed. A dotted line 34 designates the periphery of the slate bed formed by the three sheets while dotted lines 36 and 38 designate the interface of adjacent ones of the slate sheets.

When plural slate sheets are employed, cross members 40 extending between the long sides 14 and 16 of the top plate may be employed. The cross members 40 are located to underlie the projection of the interface 36 or 38 of adjacent slate sheets on the top plate 12. Of significance is the fact that each of the cross members 40 includes two pairs of the leveling assemblies 30. The first pair, designated A, is closer to the long side 14 than to the long side 16. Conversely, the assemblies 30 of a second pair B are closer to the long sides 16 than to the long sides 14. It is of particular significance to note that of the assemblies 30 in each of the pairs A and B, one assembly 30 is on one side of the interface 36 or 38 while the other assembly 30 is on the opposite of the interface 36 or 38.

Similarly leveling assemblies 30 in the long sides 14 and 16 are paired as seen in FIG. 2 and located to straddle respective ones of the projection of the interfocus.

It will also be appreciated by observing the location of all of the other assemblies 30 in relation to the line 34 designating the periphery of the slate bed that the assemblies 30 are all in a position to underlie the periphery of the slate bed 34 as well as the interfaces 36 and 38.

Figure 3:
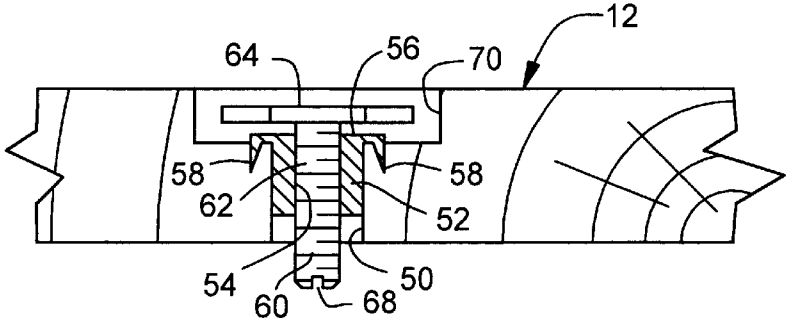
FIG. 3 is an enlarged, fragmentary sectional view taken approximately along the line 3—3 in FIG. 2.

Referring now to FIGS. 1 and 3, at the location of each of the leveling assemblies 30, the top plate 12 is provided with a bore 50 which receives a nut 52 of generally tubular configuration having an internally threaded bore 54. The upper end of each of the nuts 52 has a radially outwardly directed flange 56 which terminates at several locations in downwardly directed spikes or prongs 58. The prongs 58 are embedded into the top plate 12 and thus prevent the nut 52 from rotating within the top plate. The nuts 52 are generally referred to as tee-nuts and are commercially available from many sources.

Threaded within each of the nuts 52 is a leveling screw 60. Each leveling screw includes an elongated shaft or shank 62 which is threaded along its entire length. At one end, the shaft 62 terminates in a radially outwardly directed flange 64 which, as seen in FIG. 1, has a polygonal periphery 66. As illustrated, a hexagonal periphery is employed and this will be typical so that the flange 64, if desired, can be rotated through the use of a conventional wrench or the like.

At the opposite end, the shaft 62 includes a tool receiving formation such as a screwdriver receiving slot 68.

The arrangement is such that the flange 64 faces the underside of the slate sheet 24 while the end including the slot 68 extends below the top plate 12. By inserting a screwdriver into the slot 68, the shaft 62 may be rotated in either direction to advance the flange 64 toward or away from the slate sheet 24. Of course, when the flange 64 engages the slate sheet 24, further advancement of the shaft 64 will result in a raising of the corresponding edge of the slate sheet. This may also cause the slate sheet to tip in relation to the base frame as well. Retraction of the shaft 64 and lowering of the slate sheet will occur for the opposite direction of rotation.

As can be seen in FIGS. 1 and 3, each of the bores 50 is topped with a counterbore 70. As seen in FIG. 3, the depth of the counter bore 70 is such that the flange 64 on the screw shaft 62 may be fully retracted below the upper surface of the top plate 12. This, of course, requires that the diameter of the counter bore 70 be greater than the maximum diametrical dimension of the flange 64.

In use, the top plate is installed on the base frame in a conventional way and then the slate sheets located as shown by the dotted lines 34, 36 and 38. Using spirit levels or the like, one then retracts or advances the screw shafts 62 at the various locations to raise, lower or tip the three slate sheets until their upper surfaces 26 are in a common plane and that common plane is perfectly horizontal. As will be readily appreciated, because of the nature of a screw and nut combination, once the adjustment is made, unless a tool is applied to each assembly subsequently, the adjustment will be maintained due to the high friction present. Thus, unlike shims, proper leveling cannot be lost as a result of the leveling assembly loosening.

Furthermore, because the leveling assemblies will typically be made of metal, they will not be susceptible to drying out nor will they be susceptible to humidity changes. As a consequence, once leveled, a level playing surface will be maintained.

Finally, it will be appreciated that through the use of judiciously placed leveling assemblies the time consuming, trial and error leveling procedure that attends the use of shims is substantially eliminated.

We claim:

1. A billiard table comprising:

a base frame adapted to be supported above an underlying terrain by legs, said base frame having an upper, top plate of generally rectangular configuration;

a slate bed made up of at least two slate sheets with planar upper surfaces and in generally side by side, abutting relation and overlying said top plate;

a plurality of nuts secured to said top plate at predetermined locations thereon; and a plurality of leveling screws, one for each nut, each leveling screw including a threaded shank threadably received in the associated nut, and a radially outward directed flange at one end of the shank at the interface of said top plate and said slate sheets and engaging one of said slate sheets;

whereby through rotation of said leveling screws, the corresponding slate sheet may be selectively raised, lowered or tipped to cause said planar surfaces to be co-planar in a perfectly horizontal plane.

2. The billiard table of claim 1 wherein said flanges have a polygonal periphery.

3. The billiard table of claim 1 wherein the end of each shank opposite said one end includes a tool receiving formation.

4. The billiard table of claim 1 wherein said top plate has a nut receiving and retaining base at each of said predetermined locations and wherein each nut is secured in its associated bore; and an enlarged counterbore in said top plate for each receiving and retaining bore, said counterbore having a depth sufficient to receive said flange and a diameter greater than the maximum diametrical dimension of said flange.

5. The billiard table of claim 1 wherein said top plate comprises an open centered rectangular element having two opposed short sides and two opposed long sides connected at their ends by said short sides, and at least one cross member extending between said long sides at a location that underlies the interface of said two slate sheets, and there are at least two said nuts in said cross member, one on each side of a projection of said slate sheet interface on said cross member.

6. The billiard table of claim 5 wherein there are four said nuts on said cross member arranged in two pairs, one of said pairs being closer to one of said long sides, the other of said pairs being closer to the other of said long sides, the nuts in each pair being on opposite sides of said projection.

7. The billiard table of claim 1 wherein said top plate includes two long sides connected by two short sides and an interface between said slate sheets extends between said long sides, each of said long sides having a pair of said nuts with the nuts of each pair being on opposite sides of a projection of said slate sheet interface on said top plate.

8. A billiard table comprising:

a base frame adapted to be supported above an underlying terrain by legs, said base frame having an upper, top plate of generally rectangular configuration;

a slate bed made up of at least one rectangular slate sheet having a planar upper surface and overlying said top plate;

a plurality of nuts secured to said top plate in spaced relation to one another and underlying the periphery of said slate sheet; and a plurality of leveling screws, one for each nut, each leveling screw including a threaded shank threadably received in the associated nut, and a radially outward directed flange at one end of the shank at the interface of said top plate and said slate sheet and engaging said slate sheet;

whereby part or parts of the periphery of said slate sheet may be raised, lowered, or tipped to locate said planar surface in a perfectly horizontal plane by rotation of selected ones of said leveling screws.

9. A billiard table comprising:

a base frame adapted to be supported above an underlying terrain by legs, said base frame having an upper, top plate of generally rectangular configuration;

a slate bed made up of at least two slate sheets with planar upper surfaces and in generally side by side abutting relation and overlying said top plate;

a plurality of nuts secured to said top plate at predetermined locations thereon; and a plurality of leveling screws, one for each nut, each leveling screw including a threaded shank threadably received in the associated nut, and a radially outward directed polygonal flange at one end of the shank at the interface of said top plate and said slate sheets and engaging one of said slate sheets; and a tool receiving formation in the end of each shank opposite said polygonal flange;

said top plate having a nut receiving and retaining bore at each of said predetermined locations with each nut secured in its associated bore;

said top plate further including an enlarged counterbore for each receiving and retaining bore, said counterbore having a depth sufficient to receive said polygonal flange and a diameter greater than the maximum diametrical dimension of said flange;

whereby, through rotation of said leveling screws, the corresponding slate sheet may be selectively raised, lowered or tipped to cause said planar surfaces to be co-planar in a perfectly horizontal plane.

10. The billiard table of claim 9 wherein said top plate comprises an open centered rectangular element having two opposed short sides and two opposed long sides connected at their ends by said short sides, and at least one cross member extending between said long sides at a location that underlies the interface of said two slate sheets, and there are at least two said nuts in said cross member, one on each side of a projection of said slate sheet interface on said cross member.

11. The billiard table of claim 10 wherein there are four said nuts on said cross member arranged in two pairs, one of said pairs being closer to one of said long sides, the other of said pairs being closer to the other of said long sides, the nuts in each pair being on opposite sides of said projection.

12. The billiard table of claim 9 wherein said top plate includes two long sides connected by two short sides and an interface between said slate sheets extends between said long sides, each of said long sides having a pair of said nuts with the nuts of each pair being on opposite sides of a projection of said slate sheet interface on said top plate.

* * * * *